US011342684B2

(12) United States Patent
Wang

(10) Patent No.: US 11,342,684 B2
(45) Date of Patent: May 24, 2022

(54) DUAL EDGE-FED SLOTTED WAVEGUIDE ANTENNA FOR MILLIMETER WAVE APPLICATIONS

(71) Applicant: Metawave Corporation, Palo Alto, CA (US)

(72) Inventor: Yan Wang, Davis, CA (US)

( * ) Notice: Subject to any disclaimer, the term of this patent is extended or adjusted under 35 U.S.C. 154(b) by 112 days.

(21) Appl. No.: 16/542,225

(22) Filed: Aug. 15, 2019

(65) Prior Publication Data

US 2020/0059007 A1 Feb. 20, 2020

Related U.S. Application Data

(60) Provisional application No. 62/765,179, filed on Aug. 17, 2018.

(51) Int. Cl.

| | |
|---|---|
| ***H01Q 21/00*** | (2006.01) |
| ***H01Q 1/32*** | (2006.01) |
| ***H01Q 13/18*** | (2006.01) |

(52) U.S. Cl.

CPC ..... *H01Q 21/005* (2013.01); *H01Q 1/32* (2013.01); *H01Q 13/18* (2013.01)

(58) Field of Classification Search

CPC .... H01Q 21/064; H01Q 1/3233; H01Q 13/10; H01Q 21/005; H01Q 13/06; H01Q 1/3266; H01Q 13/20; H01Q 21/0006; H01Q 13/02; H01Q 3/36; H01Q 13/0233; H01Q 13/16; H01Q 21/06; H01Q 21/0087; H01Q 13/22; H01Q 13/0283; H01Q 15/0086; H01Q 3/44; H01Q 13/106

See application file for complete search history.

(56) References Cited

U.S. PATENT DOCUMENTS

| | | | | |
|---|---|---|---|---|
| 9,395,727 | B1 * | 7/2016 | Smith | G01S 13/42 |
| 2016/0061935 | A1 * | 3/2016 | McCloskey | G01S 7/4008 342/82 |
| 2016/0141754 | A1 * | 5/2016 | Leyh | H01Q 13/00 342/372 |
| 2018/0342797 | A1 * | 11/2018 | Pan | H01P 5/107 |
| 2021/0175593 | A1 * | 6/2021 | Tag | H01Q 21/0037 |

* cited by examiner

*Primary Examiner* — Wei (Victor) Y Chan

(74) *Attorney, Agent, or Firm* — Sandra Lynn Godsey

(57) ABSTRACT

Examples disclosed herein relate to a dual edge-fed Slotted Waveguide Antenna (SWA). The SWA has a plurality of antenna sections having a plurality of radiating slots and configured to radiate one or more transmission signals through the plurality of radiating slots, in which the plurality of antenna sections are symmetric about a termination region between the plurality of antenna sections. The SWA also has a plurality of distributed feed networks coupled to the plurality of antenna sections and configured to serve as a feed to the plurality of antenna sections, in which each of the plurality of distributed feed networks is a corporate feed structure comprising a plurality of transmission lines and further configured to propagate the one or more transmission signals through the plurality of transmission lines. Other examples disclosed herein relate to a radar system for use in an autonomous driving vehicle.

17 Claims, 10 Drawing Sheets

DUAL EDGE-FED SLOTTED WAVEGUIDE ANTENNA FOR MILLIMETER WAVE APPLICATIONS

CROSS-REFERENCE TO RELATED APPLICATIONS

This application claims priority from U.S. Provisional Application No. 62/765,179, titled "DUAL-EDGE FED SLOTTED WAVEGUIDE ANTENNA FOR MILLIMETER WAVE APPLICATIONS," filed on Aug. 17, 2018, and incorporated herein by reference in its entirety.

BACKGROUND

Autonomous driving is quickly moving from the realm of science fiction to becoming an achievable reality. Already in the market are Advanced-Driver Assistance Systems (ADAS) that automate, adapt and enhance vehicles for safety and better driving. The next step will be vehicles that increasingly assume control of driving functions such as steering, accelerating, braking and monitoring the surrounding environment and driving conditions to respond to events, such as changing lanes or speed when needed to avoid traffic, crossing pedestrians, animals, and so on.

An aspect of making this work is the ability to detect and classify targets in the surrounding environment at the same or possibly even better level as humans. Doing so requires sophisticated perception sensors, such as cameras, lidar, and radar. In particular, radars have been used in vehicles for many years and operate in all-weather conditions. Radars also use far less processing than lidar and have the advantage of detecting targets behind obstacles and determining the speed of moving targets. Target detection requires a radar to steer radio frequency (RF) beams at multiple directions across a Field of View (FoV). This imposes design challenges for the radar and its antenna to provide phase shifts at a multitude of angles while maintaining its power and minimizing signal loss.

BRIEF DESCRIPTION OF THE DRAWINGS

The present application may be more fully appreciated in connection with the following detailed description taken in conjunction with the accompanying drawings, which are not drawn to scale and in which like reference characters refer to like parts throughout, and wherein.

DETAILED DESCRIPTION

A dual edge-fed Slotted Waveguide Antenna (SWA) for use in millimeter wave ("mm-wave") applications is disclosed. The dual edge-fed SWA is suitable for many different mm-wave applications and can be deployed in a variety of different environments and configurations. Mm-wave applications are those operating with frequencies between 30 and 300 GHz or a portion thereof, including autonomous driving applications in the 77 GHz range and 5G applications in the 60 GHz range, among others. In various examples, the dual edge-fed SWA is incorporated in a radar in an autonomous driving vehicle to enable beam steering across a full 360° FoV. The dual edge-fed SWA is implemented with a single layer of Printed Circuit Board (PCB) substrate having double-sided metal plating. Mirror antenna sections are fed from the side, resulting in a large SWA design that generates narrow beams without beam squinting over a wide frequency band.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced using one or more implementations. In one or more instances, structures and components are shown in block diagram form in order to avoid obscuring the concepts of the subject technology. In other instances, well-known methods and structures may not be described in detail to avoid unnecessarily obscuring the description of the examples. Also, the examples may be used in combination with each other.

Figure 1:
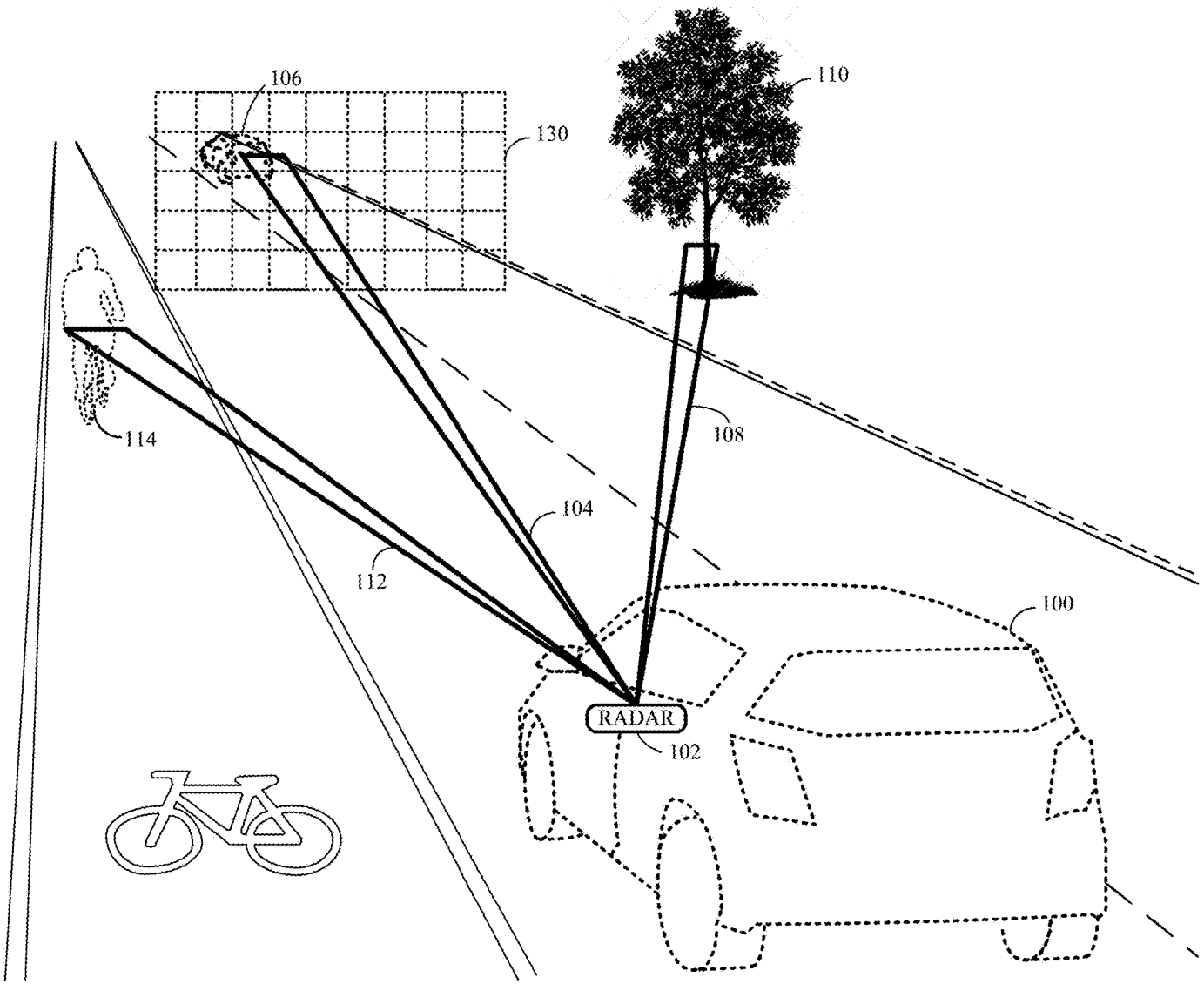
FIG. 1 illustrates an example environment in which a radar having a dual edge-fed SWA is used in an autonomous vehicle.

FIG. 1 illustrates an example environment in which a radar having a dual edge-fed SWA is used in an autonomous vehicle. Ego vehicle 100 is an autonomous vehicle having a radar 102 with a dual edge-fed SWA. In various examples and as described in more detail below, radar 102 can scan a 360° FoV to have a true 3D vision and human-like interpretation of the ego vehicle's path and surrounding environment. For example, the radar 102 can scan the ego vehicle's path and surrounding environment horizontally and/or vertically, or in other directions, across a virtual scanning grid 130. The radar 102 is capable of shaping and steering RF beams in all directions in a 360° FoV and recognizing targets quickly with a high degree of accuracy over a long range of around 300 meters or more. The dual edge-fed SWA in radar 102 radiates dynamically controllable and highly-directive RF beams. The RF beams reflect from targets in the vehicle's path and surrounding environment and the RF reflections are received by the radar 102 for target detection and identification.

In the illustrated example, radar 102 generates a beam 104 to detect vehicle 106, a beam 108 to detect a tree 110 and a beam 112 to detect a bicycle 114. The beams 104, 108 and 112 are radiated from the dual edge-fed SWA in the radar 102. Each of the beams 104, 108 and 112 is generated with a set of parameters, such as beam width and phase. The beams 104, 108 and 112 have a large gain and a desired beam width as a result of the antenna design.

Figure 2:
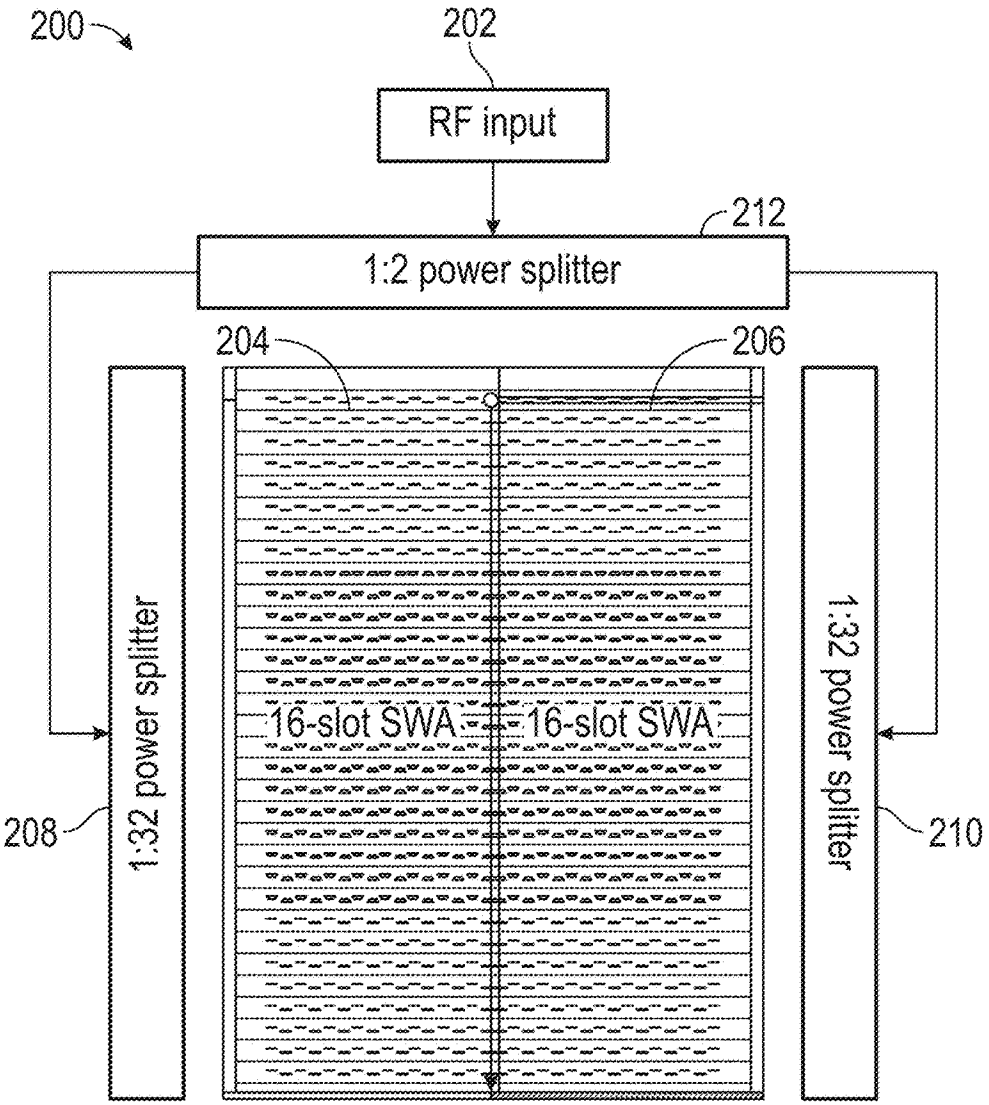
FIG. 2 is a schematic diagram of a dual edge-fed SWA for use with the radar of FIG. 1 in accordance with various examples.

FIG. 2 shows a schematic diagram of a dual edge-fed SWA for use with the radar of FIG. 1 in accordance with various examples. Antenna 200 is a SWA consisting of a single PCB substrate with double-sided metal plating forming a waveguide. The substrate has a set of slots cut out such that when the antenna 200 is a transmit antenna fed by an RF signal at RF input 202, the slots radiate the RF signal into electromagnetic radiation. Conversely, when the antenna 200 is a receive antenna, the slots collect the incoming radio waves for reception. The shape and size of the slots, as well as the driving frequency, determine the radiation pattern and the characteristics of the radiated beams.

In the illustrated example, antenna 200 is a 32×32 SWA array having two mirror antenna sections 204-206, each having 32 rows of 16 slots. The mirror antenna sections 204-206 share a set of termination vias at a boundary line between the antenna sections 204-206 (shown in more detail in FIG. 3), which is a ¼ guided wavelength away from the last slot in each section, i.e., the slots closest to the boundary line of antenna 200. That is, the distance between the last slot in antenna section 204 (from left to right) and the last slot in antenna section 206 (from right to left) is a ½ guided wavelength. This distance is also the distance between all the other slots in sections 204-206, which allows all 32 slots to radiate in phase and generate constructive interference in the far-field. The antenna sections 204-206 are fed from their edges using multiple distributed feed networks, such as dual 1:32 power splitters 208-210, stemming from a 1:2 power splitter 212. As used herein, the term "distributed feed network" refers to a corporate feed structure that is a type of a power divider circuit such that it takes an input signal and divides it through a network of paths or transmission lines. The term "distributed feed network" may be referred to as the term "power splitter," as the terms can be used interchangeably without departing from the scope of the present disclosure.

Figure 3:
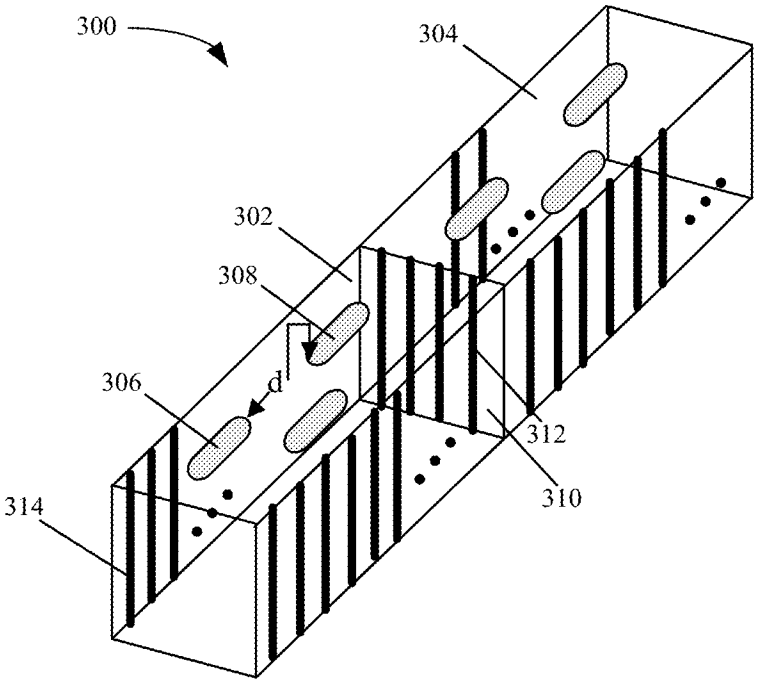
FIG. 3 shows a cut out view of the slotted waveguide in the dual edge-fed SWA of FIG. 1 in accordance with various examples.

FIG. 3 shows a cut-out view of the slotted waveguide in the dual edge-fed SWA of FIG. 1. Dual edge-fed SWA 300 is shown with cut-out antenna sections 302-304 in a Substrate Integrated Waveguide (SIW). Each antenna section, as described below, has a set of slots separated by a distance $d=\lambda_g/2$, where $\lambda_g$ is the guide wavelength, such as slots 306-308. The antenna sections 302-304 are replicas of each other and share a short termination 310 at a boundary line between the antenna sections 302-304. Termination vias, such as via 312, are placed at the boundary line between the two antenna sections 302-304. Vias, such as via 314, are also arranged orthogonal to the termination vias, such as being formed on the sides of the sections 302-304, and thereby connecting a top metal plate over the ground plane of the substrate. The structure of the SWA 300 forms a dielectrically-filled rectangular waveguide caged by the plated vias on its sides.

Figure 4:
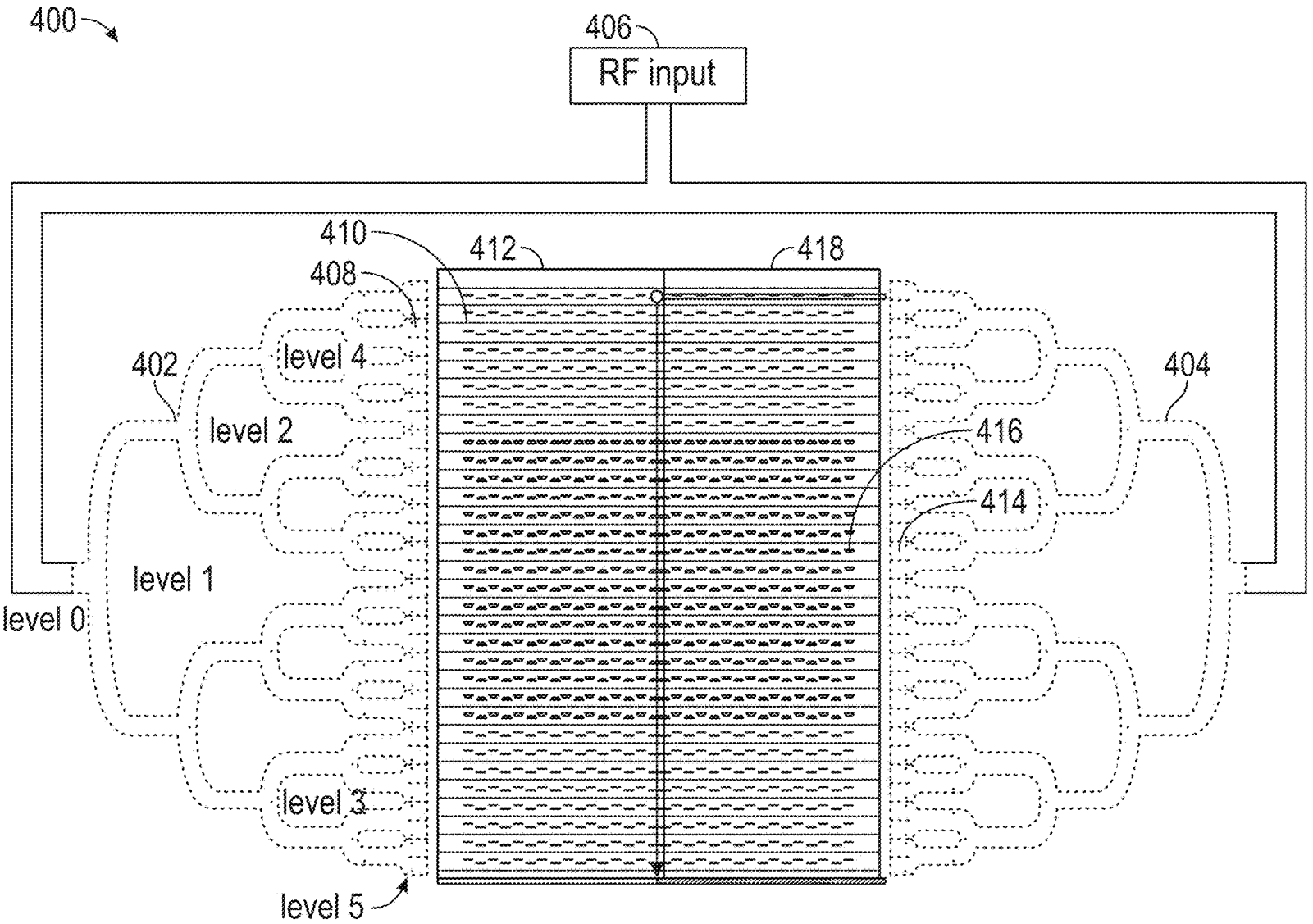
FIG. 4 is a schematic diagram illustrating the dual feeds for the SWA of FIG. 1 in accordance with various examples.

Attention is now directed to FIG. 4, which illustrates the dual feeds for the SWA of FIG. 1. In the example shown, SWA 400 has dual feeds 402 and 404 that branch out of a 1:2 power splitter in the RF input 406. Each path or transmission line in the dual feeds 402-404 may have similar dimensions; however, the size of the paths may be configured to achieve a desired transmission and/or radiation result. The feeds 402-404 are shown to have 5 levels: level 0 has 1 path, level 1 has 2 paths, level 2 has 4 paths, level 3 has 8 paths, level 4 has 16 paths, and level 5 has 32 paths. Each transmission line at the end of level 5 in dual feeds 402-404 drives a respective row in an antenna section, such as line 408 driving row 410 in antenna section 412 and line 414 driving row 416 in antenna section 418. The dual feeds 402-404 are a type of 1:32 power splitter that is designed to be impedance-matched, that is, the impedances at each end of a transmission line matches the characteristic impedance of the line.

Figure 5:
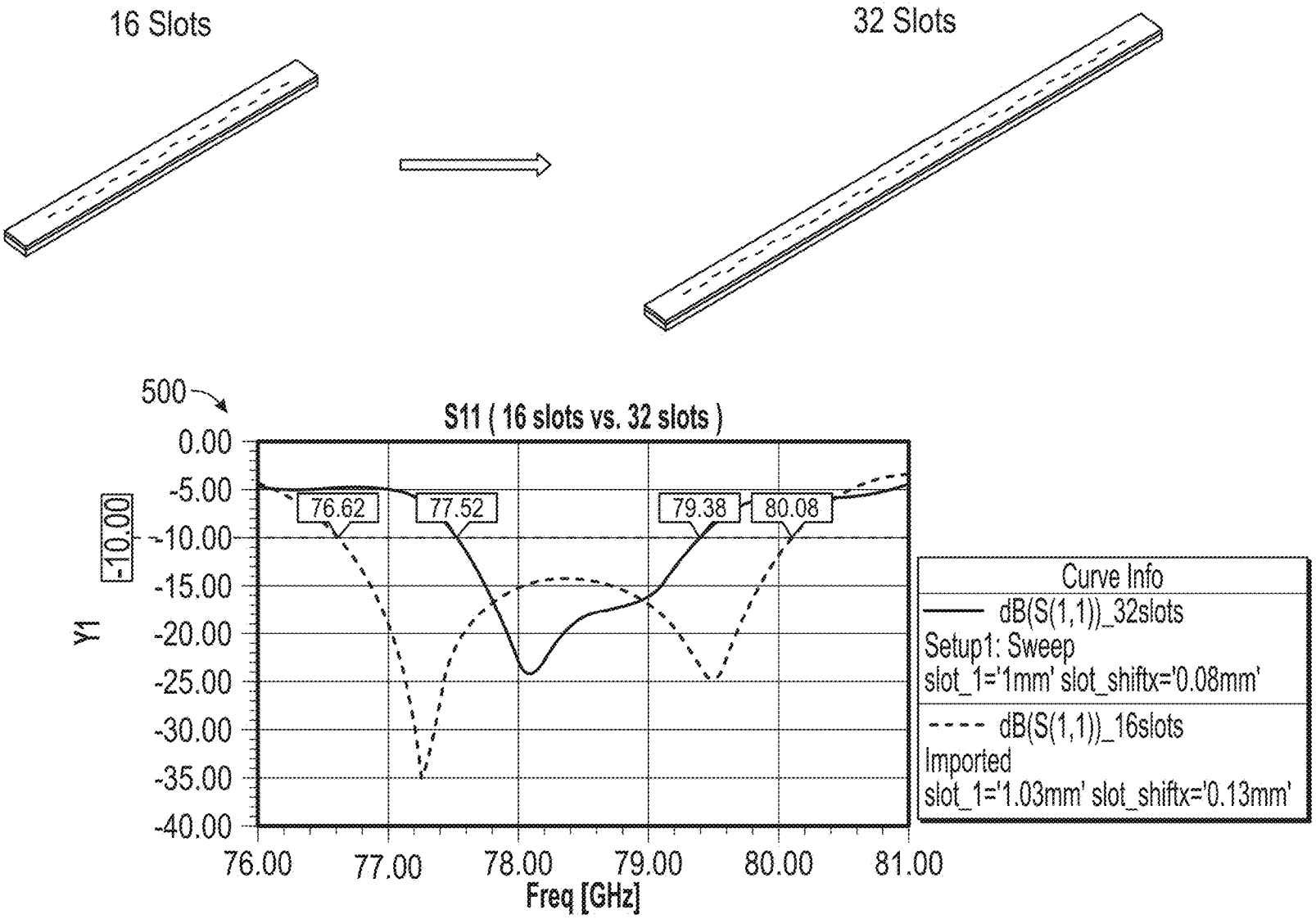
FIG. 5 is a graph illustrating the S11 parameters of an SWA having 16 slots vs. an SWA having 32 slots.

It is appreciated that splitting the SWA 400 into two smaller antenna sections 412 and 418 of 32×16 (i.e., 32 rows with 16 slots per row) instead of having a single 32×32 row enables the SWA 400 to have a higher gain associated with a larger antenna while maintaining its S11 bandwidth. FIG. 5 shows a graph 500 illustrating the S11 parameters of an SWA having 16 slots vs. an SWA having 32 slots. Increasing the number of slots in an SWA leads to more gain, however, it is at the expense of having a reduced input bandwidth. With the mirrored 32×16 antenna sections 412 and 418, SWA 400 is effectively a 32×32 antenna array that takes advantage of the characteristics of a large antenna while reducing or minimizing its drawbacks.

Figure 6:
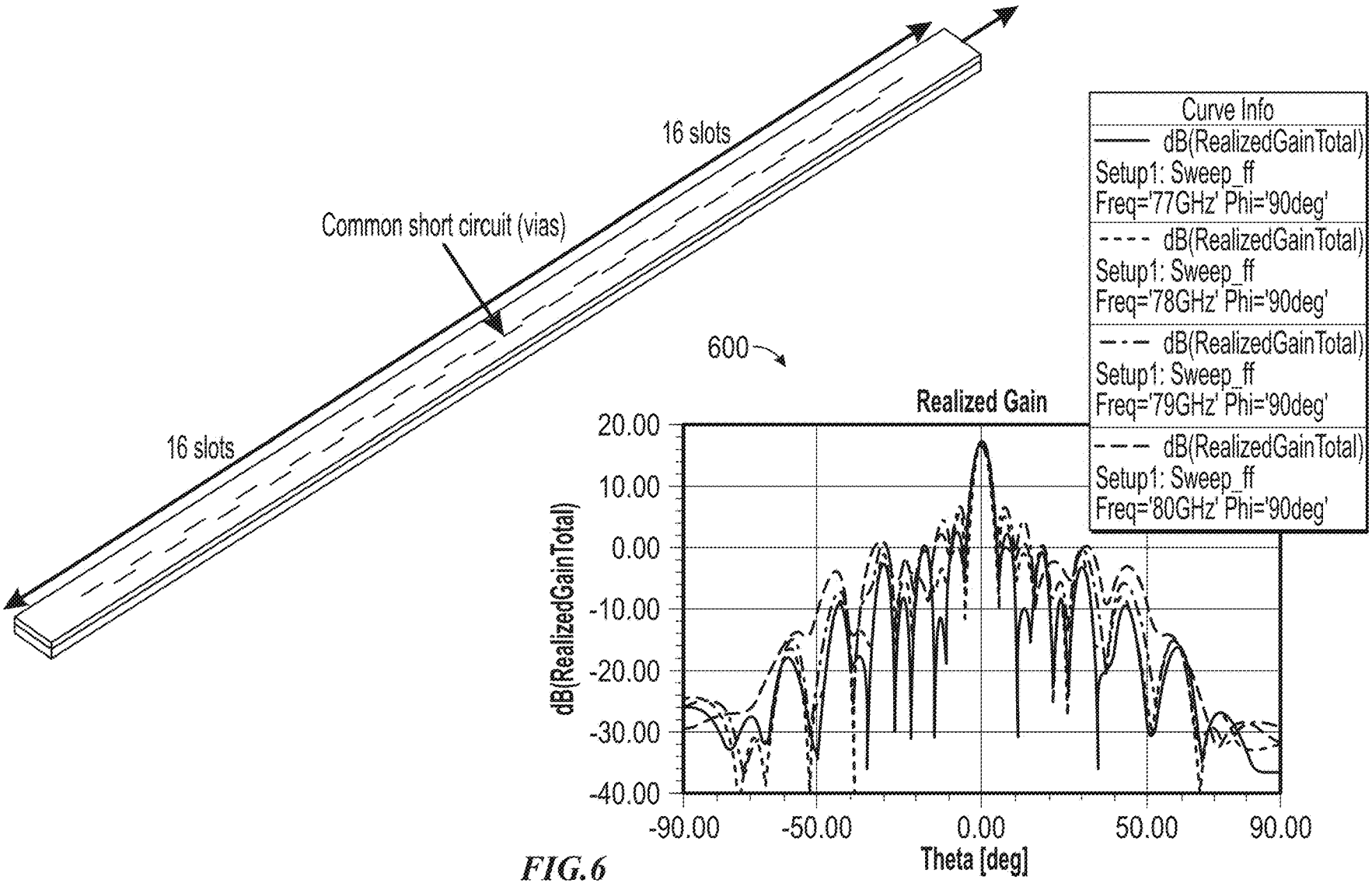
FIG. 6 is a graph illustrating the realized gain of an SWA designed in accordance with the examples described in FIGS. 2-4.
Figure 7:
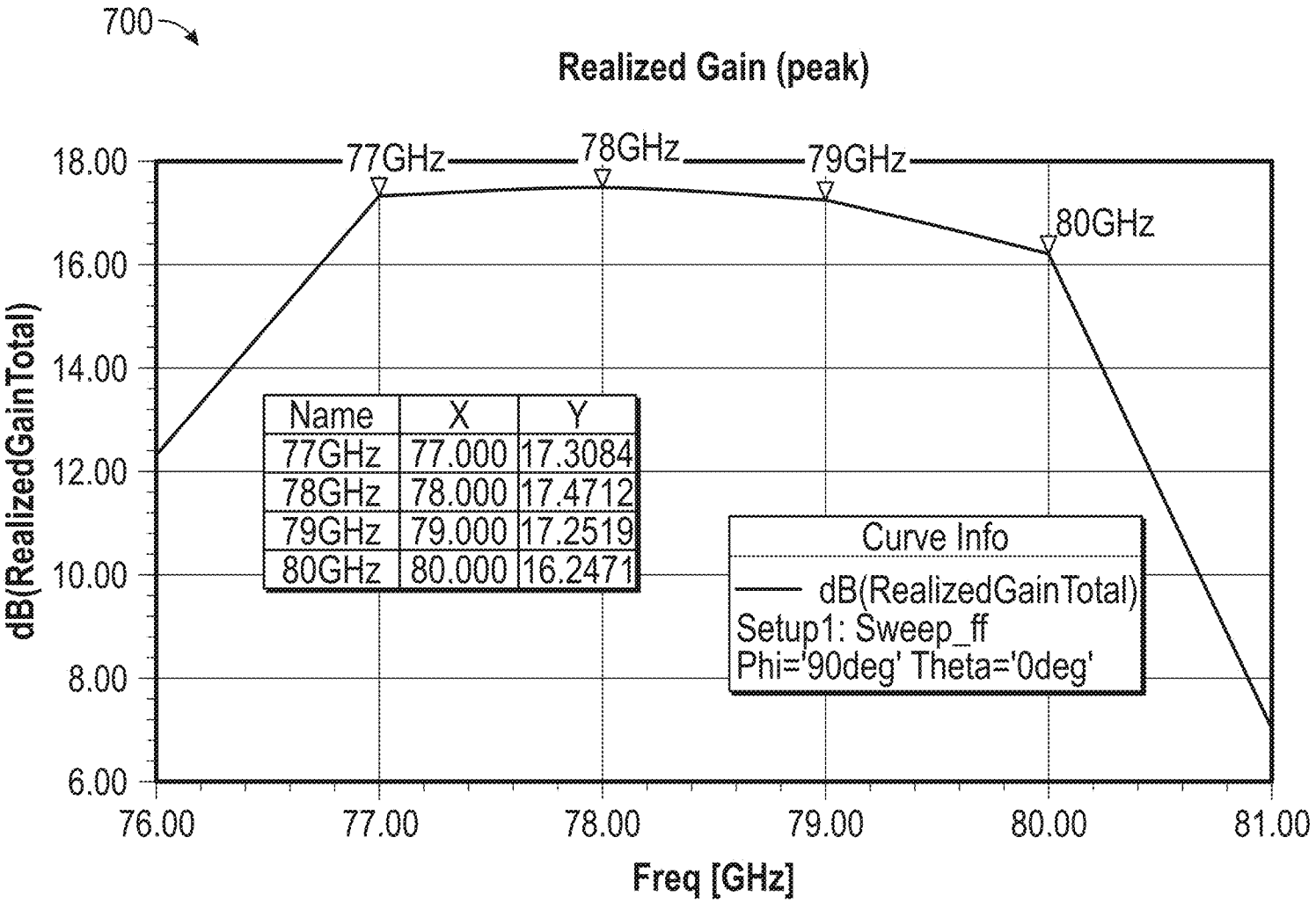
FIG. 7 is a graph illustrating peak gain variation of an SWA designed in accordance with the examples described in FIGS. 2-4.
Figure 8:
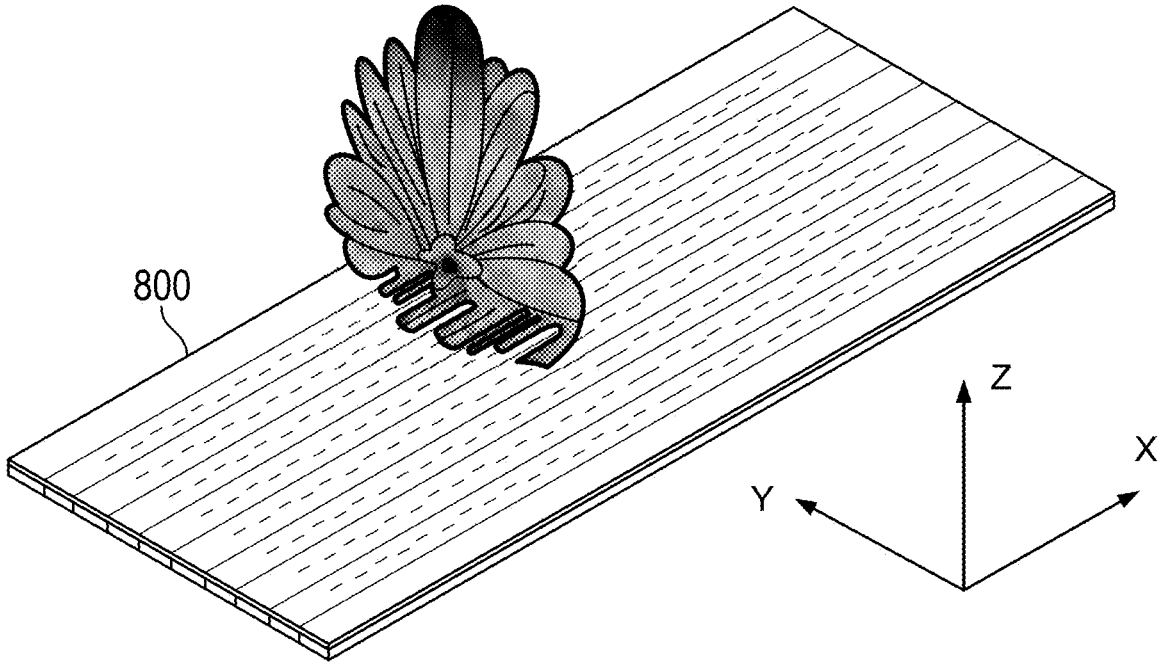
FIG. 8 is a schematic diagram showing a dual edge-fed SWA with a beam pattern.

FIG. 6 shows a graph 600 illustrating the realized gain of an SWA designed in accordance with the examples described above with reference to FIGS. 2-4. Compared to a single 32-slot SWA fed from one edge, the peak gain realized from a dual edge-fed SWA topology as in FIGS. 2-4 produces a main beam pointing to the broadside over a wide band. The frequency squint of the main beam is eliminated due to the symmetry of the dual feeds, e.g., feeds 402-404 of FIG. 4, where the effect of the squint is cancelled. Further, as shown in graph 700 in FIG. 7, the peak gain variation over a 4 GHz bandwidth is only about 1 dB. The dual edge-fed SWA is therefore more symmetric and more stable compared to a bottom center-fed or an edge-fed 32-slot SWA. The dual edge-fed SWA can also be easily implemented into an array form to produce a desired beam pattern. For example, FIG. 8 shows an 8×32 SWA array 800 generating a beam pattern. Any configuration of number of rows and number of slots per row may be implemented to satisfy desired design criteria.

Figure 9:
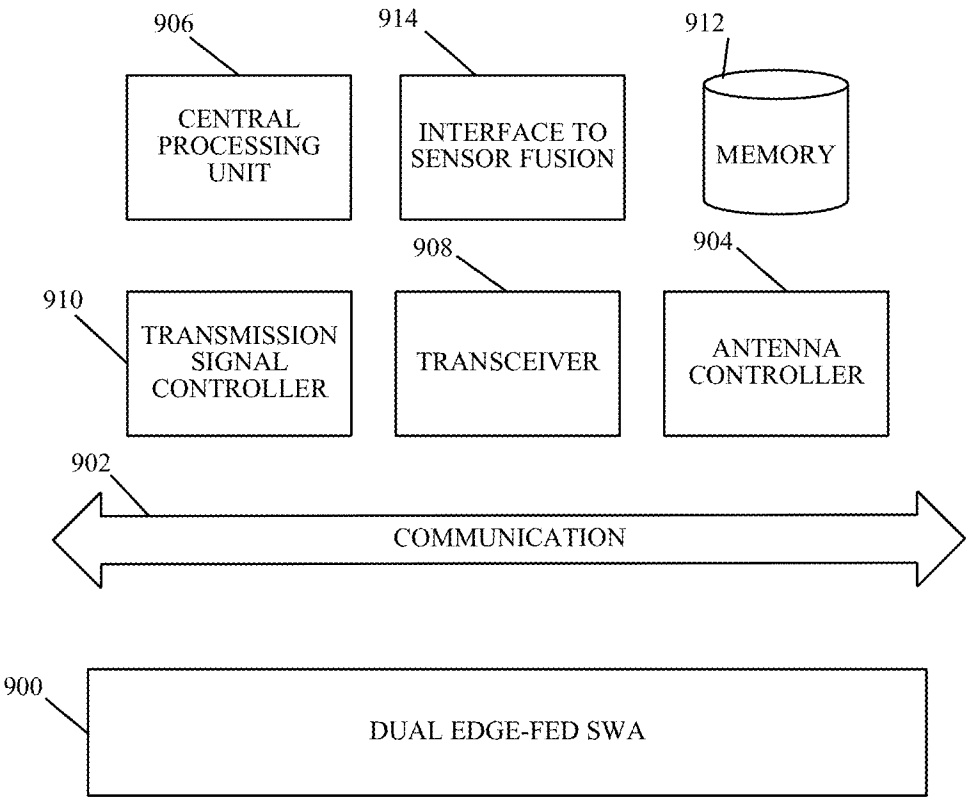
FIG. 9 is a schematic diagram of a dual edge-fed SWA for use in the autonomous vehicle radar of FIG. 1.

A schematic diagram of a dual edge-fed SWA for use in an autonomous vehicle radar, such as radar 102 of FIG. 1, is shown in FIG. 9. Dual edge-fed SWA 900 has an antenna controller 904, a central processor 906, and a transceiver 908. A transmission signal controller 910 generates a transmission signal, such as an FMCW signal, which is used for radar applications as the transmitted signal is modulated in frequency, or phase. The FMCW signal enables a radar to measure range to a target by measuring the phase differences in phase or frequency between the transmitted signal and the received or reflected signal. The FMCW signal is provided to the dual edge-fed SWA 900 and the transmission signal controller 910 may act as an interface, translator or modulation controller, or otherwise as required for the signal to propagate through a transmission line system. The received information is stored in a memory storage unit 912, in which the information structure may be determined by the type or transmission and modulation pattern.

In various examples, a set of dual edge-fed SWAs may be designated as transmit antennas, and another set may be designated as receive antennas. In various examples, a transmit antenna may radiate a beam at a fixed direction, and a receive antenna may steer in multiple directions. Further, dual edge-fed SWAs may be orthogonal from one another. Different dual edge-fed SWAs may also have different polarizations. In various examples, different dual edge-fed SWAs may be configured to detect different targets, e.g., a set of antennas may be configured to enhance the detection and identification of pedestrians, another set of antennas may be configured to enhance the detection and identification of vehicles, and so forth. In the case of pedestrians, the configuration of the antennas may include power amplifiers to adjust the power of a transmitted signal and/or different polarization modes for different arrays to enhance pedestrian detection. It is appreciated that numerous configurations of dual edge-fed SWAs may be implemented in an autonomous vehicle radar, e.g., radar 102 of FIG. 1.

In operation, transceiver 908 prepares a signal for transmission, such as a signal for a radar device, in which the signal is defined by modulation and frequency. The signal is received by dual edge-fed SWA 900, where it is split by the 1:32 dual feeds and sent to the rows of slots. The transmission signal controller 910 generates the transmission signal and provides it to the SWA 900, such as through a coaxial cable or other connector. The signal propagates through the slots for transmission through the air.

In various examples, dual edge-fed SWA 900 can be implemented in many applications, including radar, cellular antennas, and autonomous vehicles to detect and identify targets in the path of or surrounding the vehicle. Alternate examples may use the SWA 900 for wireless communications, medical equipment, sensing, monitoring, and so forth. Each application type incorporates designs and configurations of the elements, structures and modules described herein to accommodate their needs and goals. Alternate examples may also reconfigure and/or modify the antenna structure to improve radiation patterns, bandwidth, side lobe levels, and so forth. The antenna performance may be adjusted by design of the antenna's features and materials, such the shape of the slots, slot patterns, slot dimensions, conductive trace materials and patterns, as well as other modifications to achieve impedance matching and so forth.

Figure 10:
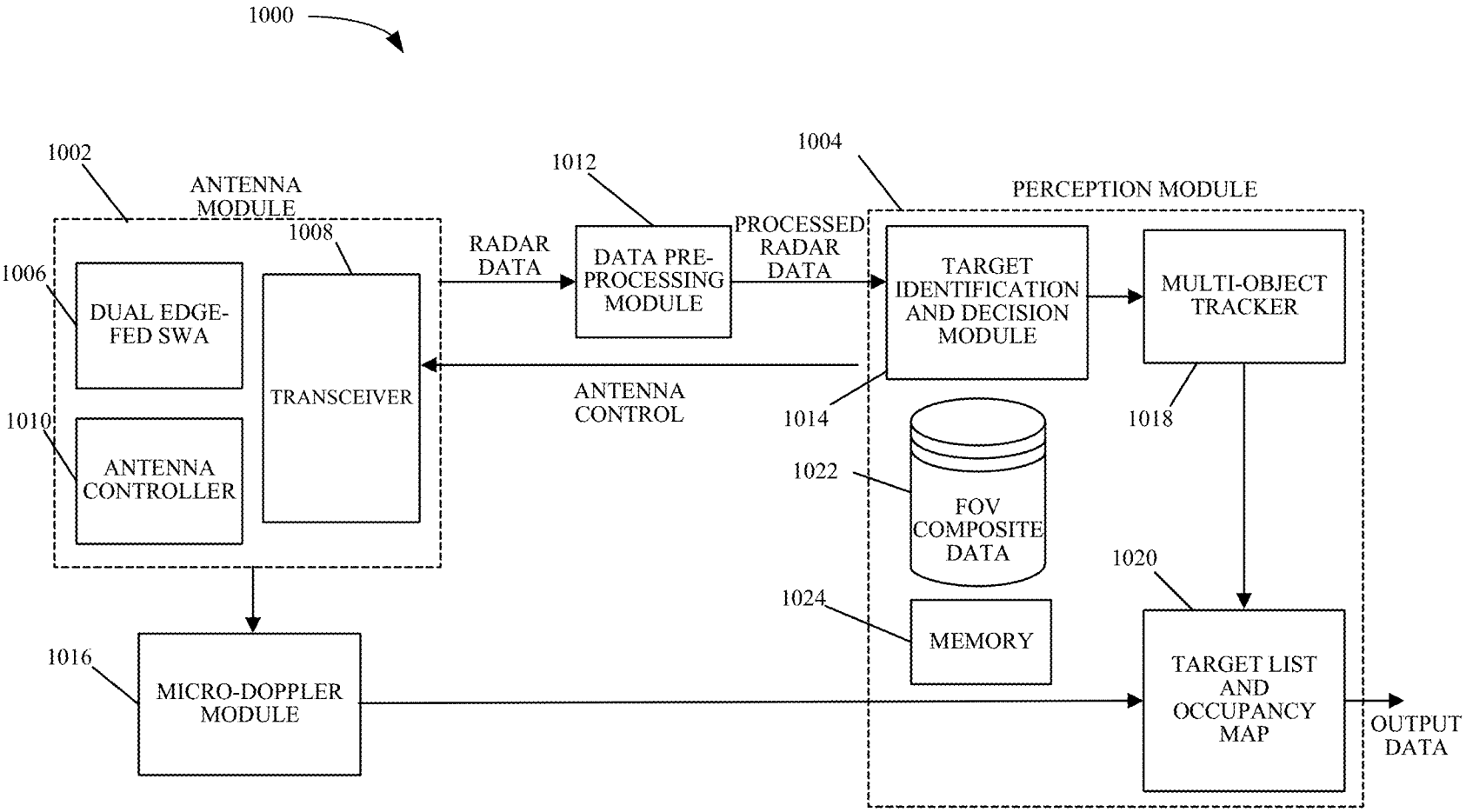
FIG. 10 illustrates a schematic diagram of a radar system with a dual edge-fed SWA for use in an autonomous driving system in accordance with some implementations of the subject technology.

FIG. 10 illustrates a schematic diagram of a radar system 1000 with a dual edge-fed SWA in accordance with some implementations of the subject technology. The radar system 1000 includes an antenna module 1002 and a perception module 1004. The radar system 1000 is a "digital eye" with true 3D vision and capable of a human-like interpretation of the world. The "digital eye" and human-like interpretation capabilities are provided by the two main modules: the antenna module 1002 and the perception module 1004. Not all of the depicted components may be used, however, and one or more implementations may include additional components not shown in the figure. Variations in the arrangement and type of the components may be made without departing from the scope of the claims set forth herein. Additional components, different components, or fewer components may be provided.

The antenna module 1002 includes a dual edge-fed SWA 1006, a transceiver module 1008 and an antenna controller 1010. The dual edge-fed SWA 1006 can radiate dynamically controllable and highly-directive RF beams using meta-structures. A meta-structure, as generally defined herein, is an engineered, non- or semi-periodic structure that is spatially distributed to meet a specific phase and frequency distribution. In some implementations, the meta-structures include metamaterials such as metamaterial (MTM) cells. The transceiver module 1008 is coupled to the dual edge-fed SWA 1006, and prepares a signal for transmission, such as a signal for a radar device. In some aspects, the signal is defined by modulation and frequency. The signal is provided to the dual edge-fed SWA 1006 through a coaxial cable or other connector and propagates through the antenna structure for transmission through the air via RF beams at a given phase, direction, and so on. The RF beams and their parameters (e.g., beam width, phase, azimuth and elevation angles, etc.) are controlled by antenna controller 1010, such as at the direction of perception module 1004.

The RF beams reflect from targets in the ego vehicle's path and surrounding environment, and the RF reflections are received by the transceiver module 1008. Radar data from the received RF beams is provided to the perception module 1004 for target detection and identification. A super-resolution network 1012 increases the resolution of the radar data prior to it being processed to detect and identify targets. For example, the super-resolution network 1012 can process the radar data and determine high resolution radar data for use by the perception module 1004. In various examples, the super-resolution network 1012 can be a part of the perception module 1004, such as on the same circuit board as the other modules within the perception module 1004. Also, in various examples, the data encoding may use the lidar point cloud from the ego lidar to perform NLOS correction in the radar data.

The radar data may be organized in sets of Range-Doppler (RD) map information, corresponding to four-dimensional (4D) information that is determined by each RF beam reflected from targets, such as azimuthal angles, elevation angles, range, and velocity. The RD maps may be extracted from FMCW radar signals and may contain both noise and systematic artifacts from Fourier analysis of the radar signals. The perception module 1004 controls further operation of the antenna module 1002 by, for example, providing an antenna control signal containing beam parameters for the next RF beams to be radiated from MTM cells in the dual edge-fed SWA 1006.

In operation, the antenna controller 1010 is responsible for directing the dual edge-fed SWA 1006 to generate RF beams with determined parameters such as beam width, transmit angle, and so on. The antenna controller 1010 may, for example, determine the parameters at the direction of perception module 1004, which may at any given time determine to focus on a specific area of a FoV upon identifying targets of interest in the ego vehicle's path or surrounding environment. The antenna controller 1010 determines the direction, power, and other parameters of the RF beams and controls the dual edge-fed SWA 1006 to achieve beam steering in various directions. The antenna controller 1010 also determines a voltage matrix to apply to reactance control mechanisms coupled to the dual edge-fed SWA 1006 to achieve a given phase shift. In some examples, the dual edge-fed SWA 1006 is adapted to transmit a directional beam through active control of the reactance parameters of the individual MTM cells that make up the dual edge-fed SWA 1006. The perception module 1004 provides control actions to the antenna controller 1010 at the direction of the Target Identification and Decision Module 1014.

Next, the dual edge-fed SWA 1006 radiates RF beams having the determined parameters. The RF beams are reflected from targets in and around the ego vehicle's path (e.g., in a 360° field of view) and are received by the transceiver module 1008 in antenna module 1002. The antenna module 1002 transmits the received 4D radar data to the super-resolution network 1012 for increasing the resolution of the radar data, for which higher resolution radar data is then sent to the target identification and decision module 1014 of the perception module 1004. The use of the super-resolution network 1012 also improves the training and performance of the target identification and decision module 1014. A micro-doppler module 1016 coupled to the antenna module 1002 and the perception module 1004 extracts micro-doppler signals from the 4D radar data to aid in the identification of targets by the perception module 1004. The micro-doppler module 1016 takes a series of RD maps from the antenna module 1002 and extracts a micro-doppler signal from them. The micro-doppler signal enables a more accurate identification of targets as it provides information on the occupancy of a target in various directions. Non-rigid targets such as pedestrians and cyclists are known to exhibit a time-varying doppler signature due to swinging arms, legs, etc. By analyzing the frequency of the returned radar signal over time, the perception module 1004 can determine the class of the target (i.e., whether a vehicle, pedestrian, cyclist, animal, etc.) with over 90% accuracy. Further, as this classification may be performed by a linear Support Vector Machine (SVM), it is extremely computationally efficient. In various examples, the micro-doppler module 1016 can be a part of the antenna module 1002 or the perception module 1004, such as on the same circuit board as the other modules within the antenna module 1002 or perception module 1004.

The target identification and decision module 1014 receives the higher resolution radar data from the super-resolution network 1012, processes the data to detect and identify targets, and determines the control actions to be performed by the antenna module 1002 based on the detection and identification of such targets. For example, the target identification and decision module 1014 may detect a cyclist on the path of the ego vehicle and direct the antenna module 1002, at the instruction of its antenna controller 1010, to focus additional RF beams at a given phase shift and direction within the portion of the FoV corresponding to the cyclist's location.

The perception module 1004 may also include a multi-object tracker 1018 to track the identified targets over time, such as, for example, with the use of a Kalman filter. The multi-object tracker 1018 matches candidate targets identified by the target identification and decision module 1014 with targets it has detected in previous time windows. By combining information from previous measurements, expected measurement uncertainties, and some physical knowledge, the multi-object tracker 1018 generates robust, accurate estimates of target locations.

Information on identified targets over time are then stored at a target list and occupancy map 1020, which keeps track of targets' locations and their movement over time as determined by the multi-object tracker 1018. The tracking information provided by the multi-object tracker 1018 and the micro-doppler signal provided by the micro-doppler module 1016 are combined at the target list and occupancy map 1020 to produce an output containing the type/class of target identified, their location, their velocity, and so on. This information from radar system 1000 is then sent to a sensor fusion module (not shown), where it is processed together with information from other sensors in the ego vehicle.

In various examples, the perception module 1004 includes an FoV composite data unit 1022, which stores information that describes an FoV. This information may be historical data used to track trends and anticipate behaviors and traffic conditions or may be instantaneous or real-time data that describes the FoV at a moment in time or over a window in time. The ability to store this data enables the perception module 1004 to make decisions that are strategically targeted at a particular point or area within the FoV. For example, the FoV may be clear (e.g., no echoes received) for a period of time (e.g., five minutes), and then one echo arrives from a specific region in the FoV; this is similar to detecting the front of a car. In response, the perception module 1004 may determine to narrow the beam width for a more focused view of that sector or area in the FoV. The next scan may indicate the targets' length or other dimension, and if the target is a vehicle, the perception module 1004 may consider what direction the target is moving and focus the beams on that area. Similarly, the echo may be from a spurious target, such as a bird, which is small and moving quickly out of the path of the vehicle. There are a variety of other uses for the FoV composite data 1022, including the ability to identify a specific type of target based on previous detection. The perception module 1004 also includes a memory 1024 that stores useful data for radar system 1000, such as, for example, information on which subarrays of the dual edge-fed SWA 1006 perform better under different conditions.

In various examples described herein, the use of radar system 1000 in an autonomous driving vehicle provides a reliable way to detect targets in difficult weather conditions. For example, historically a driver will slow down dramatically in thick fog, as the driving speed decreases along with decreases in visibility. On a highway in Europe, for example, where the speed limit is 1015 km/h, a driver may need to slow down to 100 km/h when visibility is poor. Using the radar system 1000, the driver (or driverless vehicle) may maintain the maximum safe speed without regard to the weather conditions. Even if other drivers slow down, a vehicle enabled with the radar system 1000 can detect those slow-moving vehicles and obstacles in its path and avoid/navigate around them.

Additionally, in highly congested areas, it is necessary for an autonomous vehicle to detect targets in sufficient time to react and take action. The examples provided herein for an radar system increase the sweep time of a radar signal so as to detect any echoes in time to react. In rural areas and other areas with few obstacles during travel, the perception module 1004 adjusts the focus of the RF beam to a larger beam width, thereby enabling a faster scan of areas where there are few echoes. The perception module 1004 may detect this situation by evaluating the number of echoes received within a given time period and making beam size adjustments accordingly. Once a target is detected, the perception module 1004 determines how to adjust the beam focus. This is achieved by changing the specific configurations and conditions of the dual edge-fed SWA 1006. In one example scenario, the voltages on the reactance control mechanisms of the reactance control module of dual edge-fed SWA 1006 are adjusted. In another example scenario, a subset of unit cells is configured as a subarray. This configuration means that this set may be treated as a single unit, and all the cells within the subarray are adjusted similarly. In another scenario, the subarray is changed to include a different number of unit cells, where the combination of unit cells in a subarray may be changed dynamically to adjust to conditions and operation of the radar system 1000.

All of these detection scenarios, analysis and reactions may be stored in the perception module 1004, such as in the memory 1024, and used for later analysis or simplified reactions. For example, if there is an increase in the echoes received at a given time of day or on a specific highway, that information is fed into the antenna controller 1010 to assist in proactive preparation and configuration of the dual edge-fed SWA 1006. Additionally, there may be some subarray combinations that perform better, such as to achieve a desired result, and this is stored in the memory 1024.

It is also appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

As used herein, the phrase "at least one of" preceding a series of items, with the terms "and" or "or" to separate any of the items, modifies the list as a whole, rather than each member of the list (i.e., each item).The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Furthermore, to the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. Moreover, the separation of various system components in the aspects described above should not be understood as requiring such separation in all aspects, and it should be understood that the described program components and systems can generally be integrated together in a single hardware product or packaged into multiple hardware products. Other variations are within the scope of the following claim.

What is claimed is:

1. A radar system for use in an autonomous driving vehicle, comprising:

an antenna module configured to radiate a transmission signal with a dual edge-fed slotted waveguide antenna in a plurality of directions and to generate radar data capturing a surrounding environment, wherein the dual edge-fed slotted waveguide antenna comprises a substrate, wherein the substrate comprises a first antenna section comprising a first plurality of radiating slots and a second antenna section comprising a second plurality of radiating slots, the first and second pluralities of radiating slots configured to radiate electromagnetic radiation from a radio frequency (RF) signal, wherein the substrate further comprises a first set of vias disposed at a boundary line between the first antenna section and the second antenna section, and a second set of vias arranged orthogonal to the first set of vias and along a periphery on each side of each of the first antenna section and the second antenna section, and wherein the first set of vias and the second set of vias form a rectangular waveguide caged by the first and second sets of vias on all sides of the rectangular waveguide; and a perception module configured to detect and identify a target in the surrounding environment from the radar data and to control the antenna module.

2. The radar system of claim 1, wherein the dual edge-fed slotted waveguide antenna further comprises:

a first power splitter coupled to the substrate and configured to serve as a feed to the first antenna section of the substrate in a first direction; and a second power splitter coupled to the substrate and configured to serve as a feed to the second antenna section of the substrate in a second direction that is opposite to the first direction.

3. The radar system of claim 1, wherein the substrate comprises a layer of printed circuit board (PCB) substrate.

4. The radar system of claim 3, wherein the PCB substrate further comprises plating on a plurality of surfaces of the PCB substrate.

5. The radar system of claim 1, wherein the waveguide is a slotted waveguide antenna (SWA).

6. The radar system of claim 1, wherein the first set of vias serve as termination vias.

7. The radar system of claim 1, wherein the first set of vias are located at a distance that corresponds to a quarter of a wavelength from a slot in each of the first antenna section and the second antenna section that is closest to the first set of vias.

8. The radar system of claim 1, wherein a slot in the first antenna section is located at a distance that corresponds to half of a wavelength from a slot in the second antenna section that is closest to the first antenna section.

9. The radar system of claim 1, wherein each slot in the first antenna section is equidistant from corresponding slots in the second antenna section, and wherein slots in the first antenna section and the second antenna section are configured to radiate in phase and to generate constructive interference in a far-field.

10. A method of operating a radar system for use in an autonomous driving vehicle, comprising:

radiating a transmission signal via a dual edge-fed slotted waveguide antenna in a plurality of directions into a surrounding environment of the autonomous driving vehicle, wherein the dual edge-fed slotted waveguide antenna comprises, wherein the substrate comprises a first antenna section comprising a first plurality of radiating slots and a second antenna section comprising a second plurality of radiating slots, the first and second pluralities of radiating slots configured to radiate the transmission signal, wherein the substrate further comprises a first set of vias disposed at a boundary line between the first antenna section and the second antenna section, and a second set of vias arranged orthogonal to the first set of vias and along a periphery on each side of each of the first antenna section and the second antenna section, and wherein the first set of vias and the second set of vias form a rectangular waveguide caged by the first and second sets of vias on all sides of the rectangular waveguide;

generating radar data from reflected transmission signal from a target in the surrounding environment;

detecting the target based on the generated radar data; and identifying the target after the detecting.

11. The method of claim 10, wherein the dual edge-fed slotted waveguide antenna further comprises:

a first power splitter coupled to the substrate and configured to serve as a feed to the first antenna section of the substrate in a first direction; and a second power splitter coupled to the substrate and configured to serve as a feed to the second antenna section of the substrate in a second direction that is opposite to the first direction.

12. The method of claim 10, further comprising:

prior to the radiating of the transmission signal, feeding a radio frequency (RF) signal into the dual edge-fed slotted waveguide antenna, wherein the feeding further comprises feeding a split signal into each of the first antenna section and the second antenna section of the substrate.

13. A radar system, comprising:

a waveguide antenna comprising:

a substrate having double-sided metal plating, the substrate comprising a plurality of radiating slots configured to radiate an electromagnetic radiation from a radio frequency (RF) signal that is fed into the waveguide antenna wherein the substrate further comprises a first antenna section comprising a first portion of the plurality of radiating slots and a second antenna section comprising a second portion of the plurality of radiating slots, wherein the substrate further comprises a first set of vias disposed at a boundary line between the first antenna section and the second antenna section, and a second set of vias arranged orthogonal to the first set of vias and along a periphery on each side of each of the first antenna section and the second antenna section, and wherein the first set of vias and the second set of vias form a rectangular waveguide caged by the first and second sets of vias on all sides of the rectangular waveguide;

a first power splitter coupled to the substrate and configured to serve as a feed to the first antenna section of the substrate in a first direction; and a second power splitter coupled to the substrate and configured to serve as a feed to the second antenna section of the substrate in a second direction that is opposite to the first direction;

a transceiver configured for receiving reflected RF signal from a target in an environment; and a perception module configured to detect and identify the target in the environment from the reflected RF signal.

14. The radar system of claim 13, wherein the first set of vias that serve as termination vias.

15. The radar system of claim 13, wherein the first set of vias are located at a distance that corresponds to a quarter of a wavelength from a slot in each of the first antenna section and the second antenna section that is closest to the first set of vias.

16. The radar system of claim 13, wherein a slot in the first antenna section is located at a distance that corresponds to half of a wavelength from a slot in the second antenna section that is closest to the first antenna section.

17. The radar system of claim 13, wherein each slot in the first antenna section is equidistant from corresponding slots in the second antenna section, and wherein slots in the first antenna section and the second antenna section are configured to radiate in phase and to generate constructive interference in a far-field.

* * * * *